US006308563B1

(12) United States Patent
Hubbell et al.

(10) Patent No.: US 6,308,563 B1
(45) Date of Patent: Oct. 30, 2001

(54) VADOSE ZONE ISOBARIC WELL

(75) Inventors: Joel M. Hubbell; James B. Sisson, both of Idaho Falls, ID (US)

(73) Assignee: Bechtel BWXT Idaho, LLC, Idaho Falls, ID (US)

( * ) Notice: Subject to any disclaimer, the term of this patent is extended or adjusted under 35 U.S.C. 154(b) by 0 days.

(21) Appl. No.: 09/517,807

(22) Filed: Mar. 2, 2000

(51) Int. Cl.[7] ..... E21B 47/06
(52) U.S. Cl. ..... 73/152.51
(58) Field of Search ..... 73/706, 714, 715, 73/716, 756, 38, 152.51; 166/250.03, 264; 239/64, 542

(56) References Cited

U.S. PATENT DOCUMENTS 3,961,753 * 6/1976 Sears ..... 239/64
4,679,422 * 7/1987 Rubin et al. ..... 73/38
5,969,242 * 10/1999 Hubbell et al. ..... 73/152.51

* cited by examiner

*Primary Examiner*—William Oen
(74) *Attorney, Agent, or Firm*—Wells St John Roberts Gregory & Matkin

(57) ABSTRACT

A deep tensiometer is configured with an outer guide tube having a vented interval along a perforate section at its lower end, which is isolated from atmospheric pressure at or above grade. A transducer having a monitoring port and a reference port is located within a coaxial inner guide tube. The reference port of the transducer is open to the vented interval of the outer guide tube, which has the same gas pressure as in the sediment surrounding the tensiometer. The reference side of the pressure transducer is thus isolated from the effects of atmospheric pressure changes and relative to pressure changes in the material surrounding the tensiometer measurement location and so it is automatically compensated for such pressure changes.

13 Claims, 6 Drawing Sheets

VADOSE ZONE ISOBARIC WELL

This invention was made with United States Government support under Contract No. DE-AC07-94ID13223, now Contract No. DE-AC07-99ID13727 awarded by the United States Department of Energy. The United States Government has certain rights in the invention.

TECHNICAL FIELD

The invention relates to monitoring wells for groundwater or environmental investigations. More particularly, the invention relates to an apparatus and related method for more accurately measuring groundwater levels and obtaining tensiometer readings in deep wells or boreholes within a vadose zone.

BACKGROUND OF THE INVENTION

The term "groundwater" applies to water that occurs below the surface of the earth, where it occupies all or part of the void spaces in soils or geologic strata. It is also called subsurface water to distinguish it from surface water which is found in large bodies like the oceans or lakes, or which flow overland in streams.

Most groundwater comes from infiltration of precipitation. Precipitation infiltrates below the ground surface into the soil zone. There is a zone of aeration, or "vadose zone," where the interstices are occupied partially by water and partially by air. When the soil zone becomes partially saturated, water can percolate downward. A zone of saturation occurs where all the interstices are filled with water. Groundwater continues to descend until, at some depth, it merges into a zone of dense rock. Water is contained in the pores of such rocks, but the pores are not connected and water will not migrate. The upper limit of the portion of the ground wholly saturated with water is known as the water table.

Groundwater is constantly in motion. Compared to surface water, it moves very slowly, the actual rate dependent on the transmissivity and storage capacity of the aquifer. Natural outflows of groundwater take place through springs and riverbeds when the groundwater pressure is higher than atmospheric pressure in the vicinity of the ground surface. Internal circulation is not easily determined, but near the water table the average cycling time of water may be a year or less, while in deep aquifers it may be as long as thousands of years.

Groundwater plays a vital role in the development of arid and semiarid zones, sometimes supporting vast agricultural and industrial enterprises that could not otherwise exist. A vast amount of groundwater is distributed throughout the world, and a large number of groundwater reservoirs are still undeveloped or uninvestigated.

The vadose zone is a region of aeration above the water table. This zone also includes the capillary fringe above the water table, the height of which will vary according to the grain size of the sediments. In coarse-grained mediums the fringe may be flat at the top and thin, whereas in finer grained material it will tend to be higher and may be very irregular along the upper surface. The vadose zone varies widely in thickness, from being absent to many hundreds of feet, depending upon several factors. These include the environment and the type of earth material present. Water within this interval, which is moving downward under the influence of gravity, is sometimes called vadose water, or gravitational water. In the following description, it shall be referred to as "soil water"

Soil water pressure data from monitoring wells are used for various purposes. The term "well" is intended to encompass boreholes used with tensiometers. Monitored soil water pressure data is used to determine the magnitude and direction of hydraulic gradient at underground storage tanks sites, remedial investigation sites, and other sites effected by local and federal environmental laws and regulations.

The soil provides a major reservoir for water within a catchment. Soil moisture increases when there is sufficient rainfall to exceed losses to evaporation, transpiration and drainage to groundwater and streams. It is depleted during the summer when evaporation and ranspiration rates are high. Levels of soil moisture are important for plant and crop growth, soil erosion, and slope stability. The moisture status of the soil is expressed in terms of a volumetric moisture content and the capillary potential of the water held in the soil pores. As the soil becomes wet, the water is held in larger pores, and the capillary potential increases.

Capillary potential may be measured by using a tensiometer consisting of a waterfilled porous cup connected to a manometer or pressure transducer. Soil moisture content is often measured gravimetrically by drying a soil sample under controlled conditions, though there are now available moisture meters based on the scattering of neutrons, dielectric properties of water or absorption of gamma rays from a radioactive source.

The rate at which water flows through soil is dependent on the gradient of hydraulic potential (primarily the sum of capillary potential and elevation) and the physical properties of the soil expressed in terms of a parameter called hydraulic conductivity, which varies with soil moisture in a nonlinear way. Measured sample values of hydraulic conductivity have been shown to vary rapidly in space, making the use of measured point values for predictive purposes at larger scales subject to some uncertainty.

Water also moves in soil because of differences in temperature and chemical concentrations of solutes in soil water. The latter, which can be expressed as an osmotic potential, is particularly important for the movement of water into plant roots due to high solute concentrations within the root water.

Changes in atmospheric pressure (barometric pressure) might cause soil water pressure (if unsaturated) or level (if saturated) to rise and fall within the wells. The barometric pressure changes enter into soil water potential measurements because the air pressure at the depth of a monitoring tensiometer sensor might be different than the air pressure at the related land surface elevation conventionally used for reference purposes. This phenomena has been explained by several authors as it relates to groundwater measurements and is noted as an error inherent to measuring soil water conditions.

Variations in soil water potential or pressure due to barometric pressure effects have the potential to give false readings. This can result in miscalculations of items such as hydraulic gradients and flow directions, points of exposure, aquifer properties, and time to exposure from contaminated sites.

The effects of barometric fluctuations on groundwater tables are well documented. Barometric pressure changes can cause changes of up to one foot in measured water level versus actual water level. Barometric pressure fluctuations in the atmosphere can significantly impact water table levels within wells.

Errors due to barometric pressure changes are also seen in advanced tensiometer data. Several numerical solutions to adjust for effects of barometric pressure changes when using a tensiometer in a vadose zone have been proposed. Most of these corrections are inadequate because of a time lag between a pressure change in the atmosphere and the pressure in the soil column immediately above the water table. This affects the determination of direction of water flow and the calculated rate of water travel. The failure to provide "real time" corrections when using a tensiometer can make it difficult to recognize trends in soil water potential measurements.

Existing numerical solutions further require knowledge of soil/air diffusivity between the land surface above the well and the water table. The diffusivity changes with water content which, in turn, changes over time.

All of the existing numerical solutions are inadequate because there is a time lag between the pressure change of the atmosphere and the pressure applied to the soil water within a soil column immediately above the water table. This invention provides an engineering solution to the problem by routing the soil gas pressure adjacent to the porous cup of a tensiometer to its reference port on the backside of the pressure transducer, thereby correcting the data to true soil water potential. The resulting corrections are applicable to standard, advanced, or deep tensiometers when used in a vadose zone. The vadose zone isobaric well design provides data which does not include the error introduced by transient changes in barometric pressure. Barometric pressure changes are compensated automatically and on a "real time" basis, thereby saving considerable time and money in analyzing data. Removal of the barometric pressure effects on the data also allows for detection of soil water movement that previously could not be detected at sites such as waste disposal facilities.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
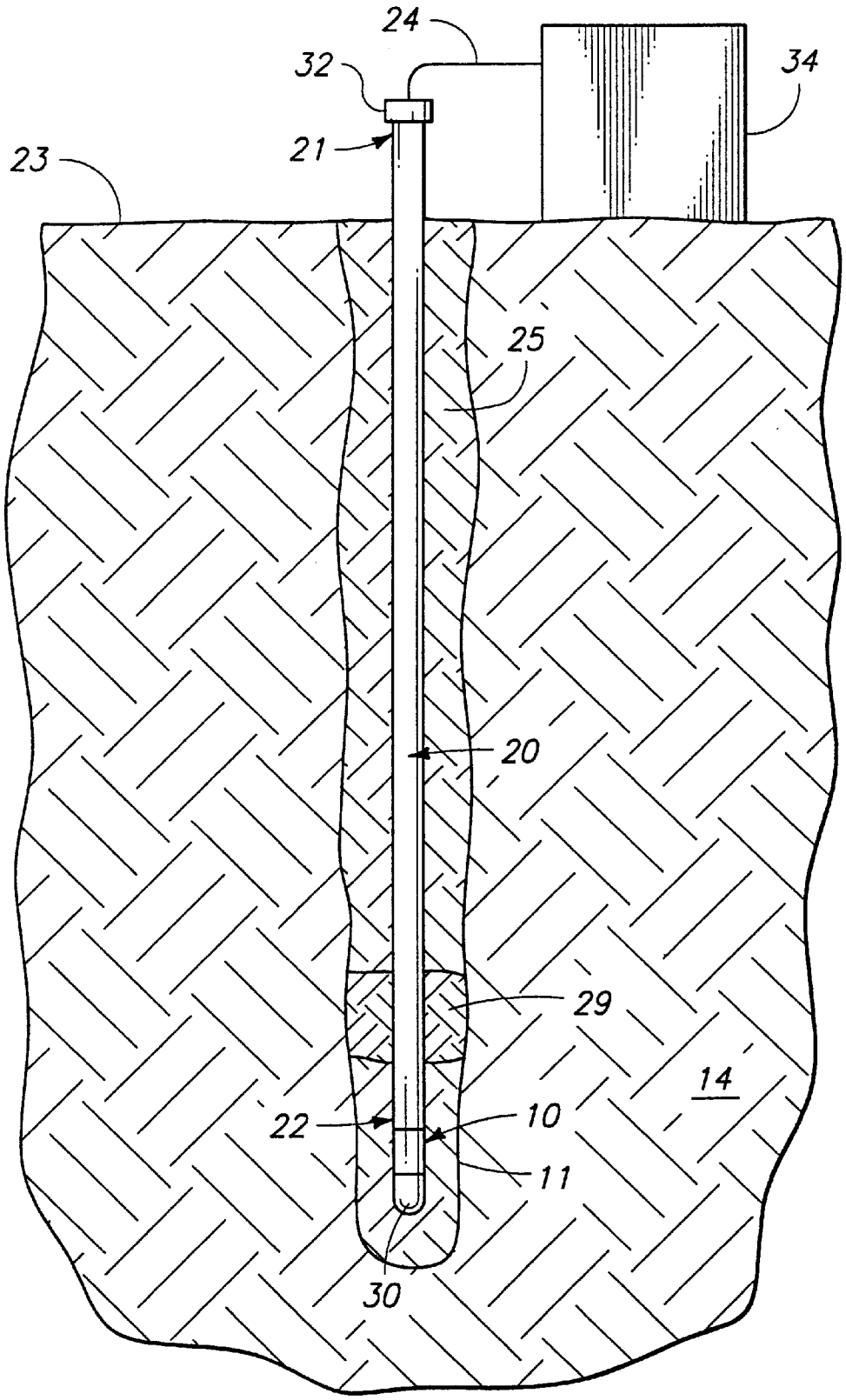
FIG. 1 is an elevational sectional view taken through a monitoring well constructed according to this disclosure.
Figure 2:
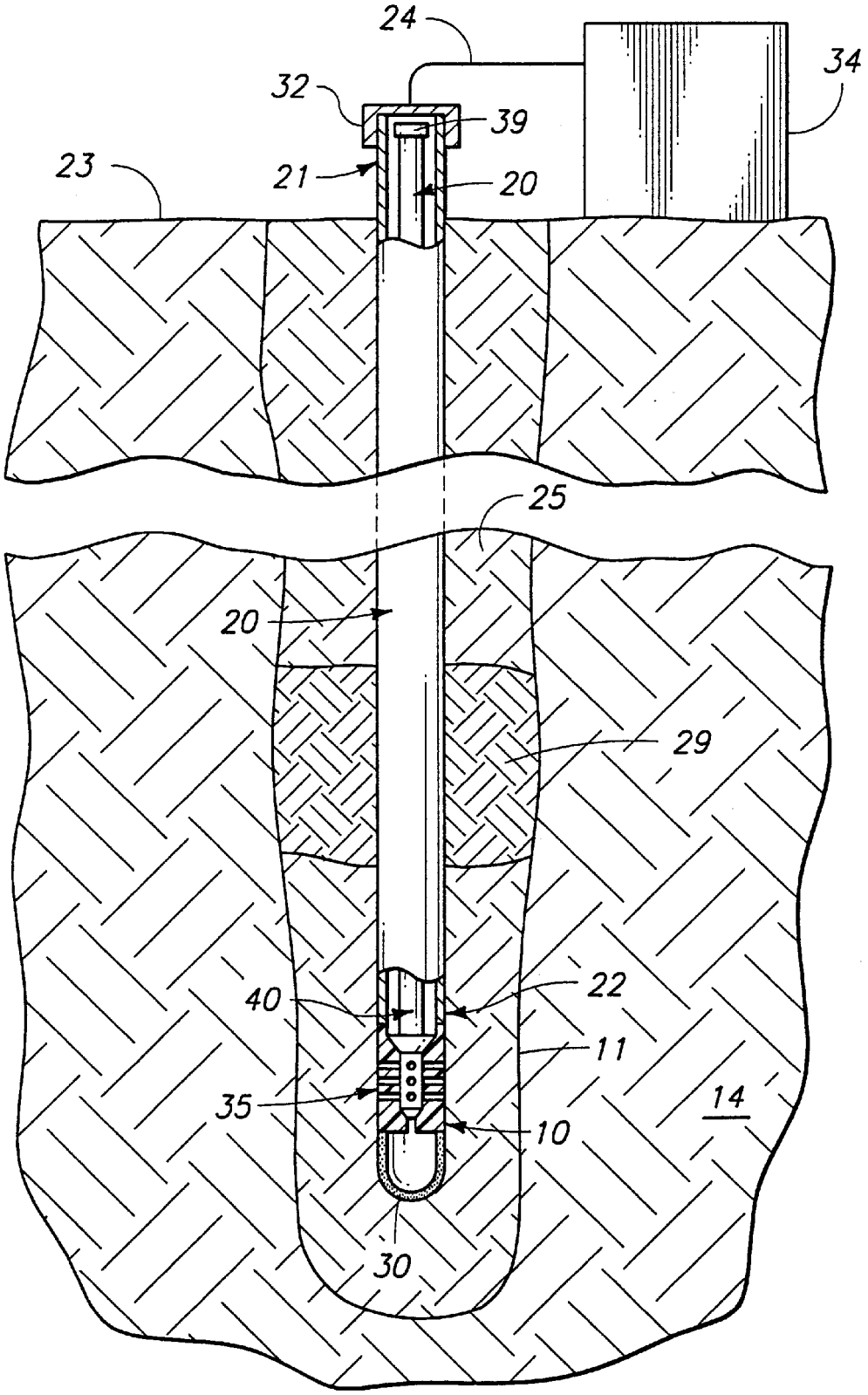
FIG. 2 is an enlarged fragmentary sectional view of the well in FIG. 1, with the lower end of the apparatus shown in section.

General Overview (FIGS. 1 and 2)

FIG. 1 shows a sectional elevation of a monitoring well incorporating the improvements to a tensiometer for use within a vadose zone. A tensiometer measures how tightly water is held to soil. Such readings are used, for example, by farmers who wish to determine when to irrigate. They are also used in the monitoring of environmentally sensitive sites to detect soil moisture movement. The present tensiometer is designed to correct for the effects of barometric pressure changes on the monitored pressure measurements taken from the well.

The monitoring well is formed in the well-known manner by digging or drilling a borehole 11 into the surrounding geologic material to a depth intersecting a vadose zone 14, which is a region of aeration above a water table (not shown). The vadose zone includes the capillary fringe above the water table. Interstices within a vadose zone are occupied partially by water and partially by air.

Aquifers overlain by an unsaturated or vadose zone of air and water within permeable geologic materials are called unconfined aquifers. The vadose zone can vary widely in vertical thickness, depending upon several factors, including the environment and the types of geologic materials present. Water within this interval moves downwardly under the influence of gravity. It is termed soil water, soil moisture, vadose water or gravitational water. The term "soil water" will be used here in. The present a system includes an upright first casing or guide tube 20. The tube 20 act s as the exterior support for the tensiometer and also prevents the borehole from collapsing. The guide tube 20 can be constructed from any material appropriate for groundwater wells, such as plastic, steel, or fiberglass. It has a top or upper end 21, a bottom or lower end 22, and an upright length in the direction between its top and bottom ends. The casing 20 is placed lengthwise into the bore 11 so as to extend from above-grade at land surface 23 to below-grade at a monitoring elevation within a vadose zone.

Fill material 25 such as sand, gravel, concrete or bentonite is placed in the bore 11 around the guide tube 20 to fix the location of guide tube 20 within the surrounding geologic material. A sealing layer 29 of bentonite might be used to restrict air and water flow in the borehole 11.

The guide tube 20 supports a tensiometer within a complementary adaptor 10 joined to the lower end 22 of guide tube 20. The adaptor 10 in turn supports a conventional porous cup 30 though which fluid communication with the surrounding soil water can be established for monitoring purposes. Cup 30 is secured in place at the lower end of adaptor 10 by a suitable fastening system, such as adhesives, threaded fasteners, and the like.

The adaptor 10 encases a pressure transducer (or sensor). The mounting arrangements for the transducer are detailed below. Transducer can be any pressure transducer appropriate for use in wells. Examples of non-amplified transducers that could be employed are Models 22PC, 24PC or 26PC, each being available from Honeywell, Microswitch, 11 West Spring St., Freeport, Ill. The transducer is used in this tensiometer to measure fluid pressure at its monitoring port relative to a reference gas pressure at its reference port.

The system further includes one or more wire leads 24 that electrically couple the pressure transducer within adaptor 10 to a conventional data logger 34 above land surface 22. The data logger 34 periodically records measurements taken by the transducer 28.

The first illustrated embodiment further includes a cap 32 that closes off the top of the guide tube 20. The upper end of a coaxial inner tube 40 is closed and sealed by an airtight cap 39 (See FIG. 2). The monitoring well of the present invention is operable to work in combination with various geophysical monitoring devices which are operable to determine various sub-grade soil parameters. In addition, the present design facilitates the removal of the transducer and the replacement or calibration of the transducer if malfunction occurs because it can be easily disengaged from within the guide tube 20 and retrieved to the earth's surface for the subsequent repair, replacement, or calibration by suitable retrieving means.

Figure 3:
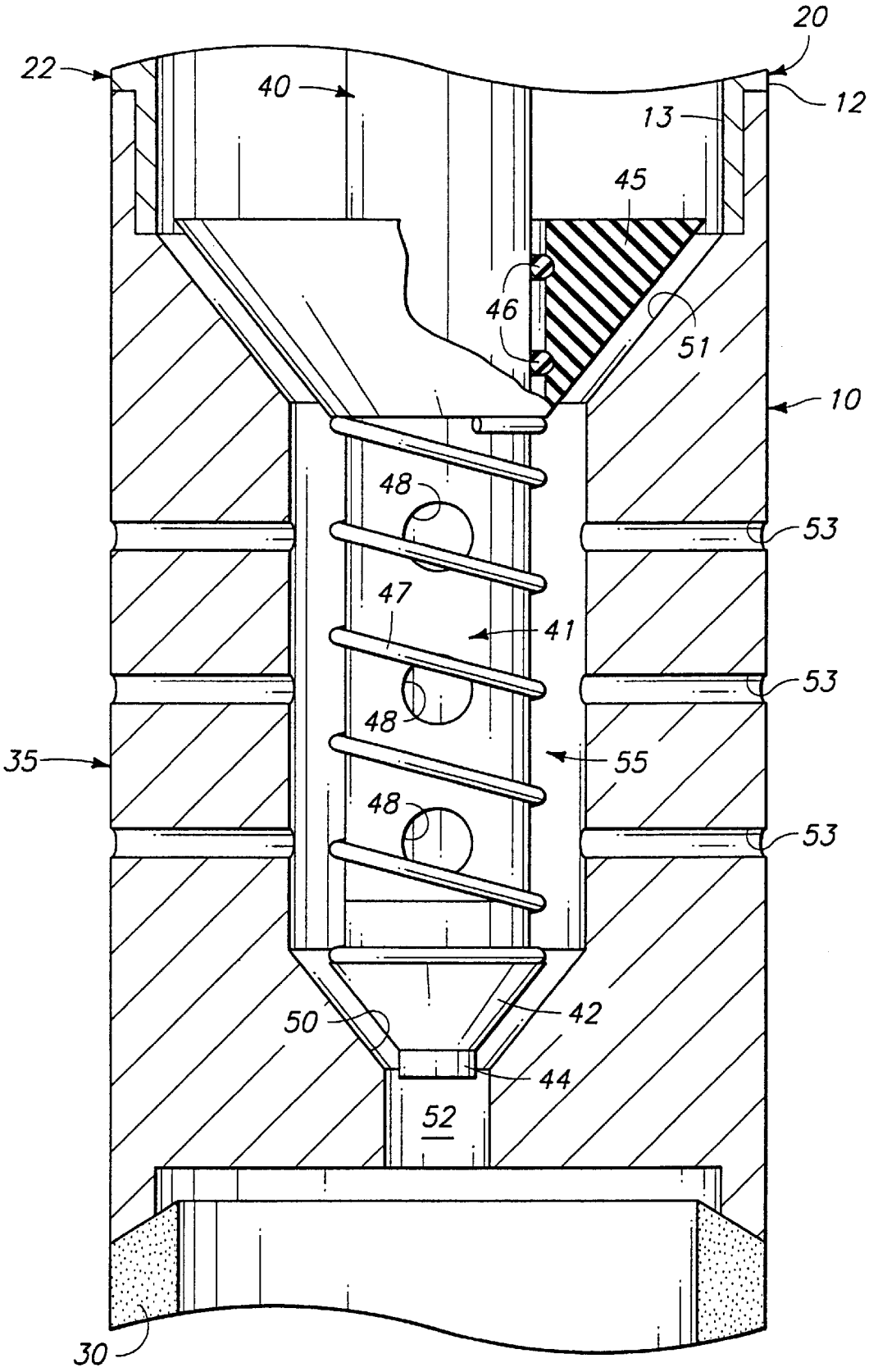
FIG. 3 is an enlarged fragmentary elevational sectional view taken through the lower end of the outer tube of the apparatus.
Figure 4:
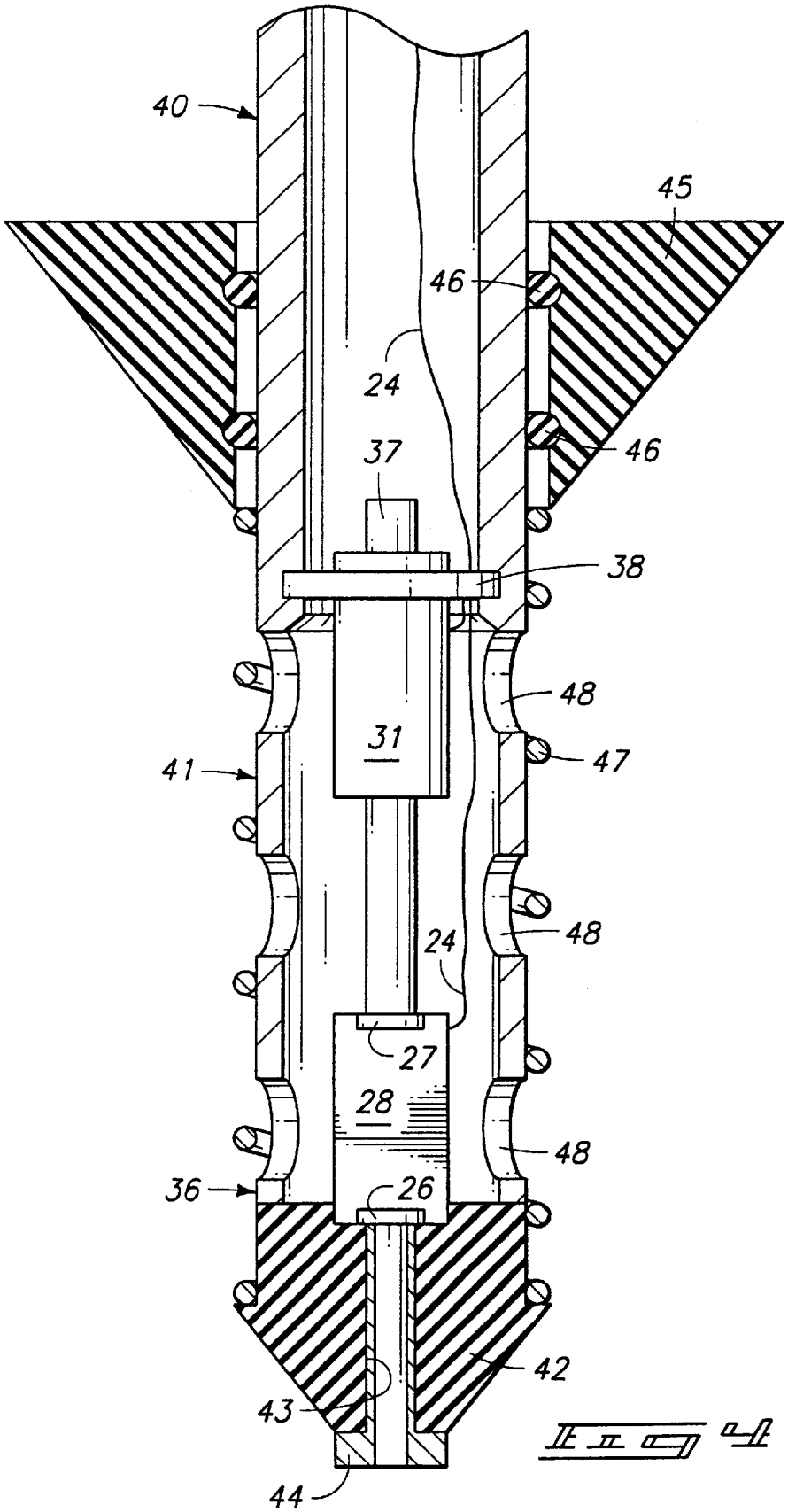
FIG. 4 is an enlarged fragmentary elevational sectional view taken through the lower end of the inner tube of the apparatus.

Tensiometer Details (FIGS. 3 and 4)

The guide tube 20 has an outside surface 12, and a coaxial inside surface 13 (see FIG. 3). Guide tube 20 is shown as a uniformly cylindrical conduit or pipe. It is joined to a cylindrical bracket 10 having a reduced inside diameter.

The transducer reference port of such tensiometers has normally been vented to the inside of the associated data logger in prior art designs. The data logger in turn has normally been vented to the surface atmosphere, which therefore has been conventionally used as a reference pressure for subsurface pressure monitoring purposes.

In the system of the illustrated embodiment, the reference port 27 is vented at the monitoring subsurface elevation. The vented connection to reference port 27 preferably includes a container 31 filled with a desiccant to protect electronic components in the transducer 28 from moisture.

Reference port 27 can be vented through the desiccant container 31 in several ways, depending on the physical configuration of the transducer 28. It can be supported is within inner guide tube 40 by a non-sealing support 38 having one or more apertures to receive wire leads 24 running between the transducer 28 and the above-ground data logger 34. It also could be floating and supported only by attachment to the transducer 28. It needs to be accessible and replaceable without substantial difficulty.

The increased thickness of adaptor 10 provides added structural strength at the bottom of guide tube 20 and increased surface area for seating of a double stopper system that seals off the adaptor 10 above and below its extremities.

The lowermost portion of adaptor 10 has a central open chamber 55 that terminates in an inner tapered seat 50 having a conical surface leading to a central aperture 52. Aperture 52 is open to the interior of porous cup 30.

The chamber 55 within adaptor 10 is vented by a pattern of holes 53. Open holes 53 permit communication between soil air at the monitoring subsurface elevation at which the tensiometer is being used and the interior chamber 55. The nature and pattern of the holes 53 are not critical to an understanding of this invention, so long as open fluid communication is established to the adjacent soil structure in order that the soil gas pressure adjacent to the bracket 10 is communicated to its interior.

The vent holes 53 can be spaced over several inches to a foot or more. They can also be elevated one or two feet above the cup 30. Then, when the cup 30 is filled with water through the interior of tube 20, excess amounts of water will hopefully be contained within bracket 10 below the elevation of the lowermost vent hole 53. If the water were to exit through vent holes 53, it would enter the surrounding geologic material and might affect subsequent measurements. The transducer 28 must also be elevated within adaptor 10 to prevent water damage to its components. Since the tensiometer is normally used in a relatively deep well, the difference of a couple feet in the reference air pressure supplied to transducer 28 through elevated locations of vent holes 53 will not often be critical. Of course, the closer it is vented to the measurement depth, the more accurate will be the resulting measurements.

The coaxial lower end 36 of inner guide tube 40 terminates in a bottom seal or gasket 42 having a conically tapered outer surface complementary to the tapered seat 50 in adaptor 10. This bottom seal 42 might be constructed of any suitable resilient material capable of sealing chamber 55 from the liquid-filled interior of cup 30. A cylindrical axial vent hole 43 extends through the bottom seal 42 (FIG. 4) and is lined by a vent tube 44 leading to the monitoring port 26 of transducer 28. The aperture of vent tube 44 defines a closed fluid path between the interior of the porous cup 30 and the monitoring port 26 of transducer 28. This path permits fluid communication between interstitial water that contacts the porous cup 30 at the monitoring elevation and the monitoring port 26.

An upper seal or gasket 45 is movably supported about the circumference of inner guide tube 40 by interior 0 rings 46. A downwardly facing tapered surface formed about If the seal 45 is complementary to an adjacent tapered surface 51 at the upper end of bracket 10. Seal 45 is also formed of a suitable resilient material capable of sealing the upper end of chamber 55 from the remaining interior volume within the first guide tube 20.

A tension spring 47 surrounding the exterior of inner guide tube 40 within chamber 55 is operatively engaged between the inner guide tube 40 and the upper seal or gasket 45. It urges the upper seal 45 downwardly toward the bottom seal 42. In this illustrated embodiment, the normal or relaxed condition of spring 47 would locate the tapered surfaces about the seals 42 and 45 just slightly closer to one another than the corresponding separation between the complementary tapered surfaces they engage at the bottom and top of the perforate section 35. Thus, as the inner guide tube 40 is inserted downwardly through the guide tube 20, the upper seal 45 will first engage tapered surface 51. Continued downward movement of inner guide tube 40 will result in extension of spring 47 and thereby permit sealing of the bottom seal 42 against the tapered seat 50 at the lower end 22 of first guide tube 20. In this way, the two seals 42 and 45 will isolate chamber 55 from both the interior of the cup 30 and the interior of the first guide tube 20, which extends upwardly from its perforate section 35.

The apparatus is completed by a series of apertures 48 formed through the wall of inner guide tube 40 adjacent to its lower end 36. The apertures 48 form a vent through the chamber 55 between the soil air at the monitoring elevation and the reference port 27 of the transducer 28. As shown, the fluid communication to reference port 27 extends from an open-ended tube 37 that leads to the desiccant container 31 to dry the air in contact with the reference port 27.

Operation of the First Embodiment

In use, the upright first guide tube 20 is buried in a vadose zone of earth and soil. Its top end 21 is accessible from a location above grade, as indicated by land surface 23 in FIGS. 1 and 2. The porous cup 30 matingly cooperates with the supporting lower end of bracket 10 to form a liquid-filled cavity surrounded by the porous cup 30. The porous cup 30 is disposed in hydraulic contact with the earthen soil in the vadose zone, and soil water is free to move through cup 30 in a manner common to all tensiometers of this nature.

After the cup 30 has been initially filled with water through the first guide tube 20, the second or inner guide tube 40 is coaxially inserted through the interior of the tube 20. The first or bottom seal 42 mounted on the lower end 36 of the second tube 40 releasably engages the bracket 10 that serves as an extension to the first guide tube 20. The axial vent hole 43 formed through the bottom seal 42 serves as an aperture which permits fluid communication between the liquid-filled cavity defined by porous cup 30 and the interior of tube 40.

The second seal 45 is mounted about the second tube 40 in spaced relation relative to the first seal 42 and also releasably engages the adaptor 10.

The interior of the inner guide tube 40 in this first embodiment must be sealed off from atmospheric pressure at grade. The required seal can be formed across the interior of the inner guide tube 40 at any elevation above the perforate section 35 of the first guide tube 20. In the illustrated embodiment, the top end of the assembled inner guide tube 40 is sealed by a cap 39 separate from the cap 32 that covers the top end of guide tube 20 (see FIG. 2). It is to be understood that the seal might be formed by any transverse imperforate wall temporarily or permanently formed across the interior of the inner guide tube 40. Because of this seal, the interior portion of the inner guide tube 40 within chamber 55 is not subjected to exterior atmospheric pressure, but only to the air pressure surrounding the vented adaptor 10 attached to the first guide tube 20.

The reference port 27 of the pressure transducer 28 is in fluid communication with the interior of the inner guide tube 40 within which it is supported. It is open to the vented interval within the first guide tube 20 between the two seals 42 and 45. The vent holes 53 formed through the adaptor 10 on the outer or first guide tube 20 allow this vented interval to have the same pressure as in the sediment surrounding the tensiometer.

The soil water adjacent to the porous cup 30 within the vadose zone being monitored has a capillary potential that is transmitted through the aperture provided by vent hole 43 in the bottom seal 42 to the monitoring port 26 of the pressure transducer. Thus, the tensiometer monitors both capillary potential and soil gas pressure at elevations adjacent to the porous cup 30, thereby correcting the resulting data transmitted to the data logger 34 to the true soil water potential on a real time basis.

The disclosed vadose zone isobaric well design provides data which does not include the error normally introduced from changes in barometric pressure. It automatically compensates for barometric pressure changes and saves considerable time and money in analyzing the resulting data. Eliminating barometric pressure effects on the data also allows detection of soil water movement that previously could not be detected at sites such as waste disposal facilities.

Figure 5:
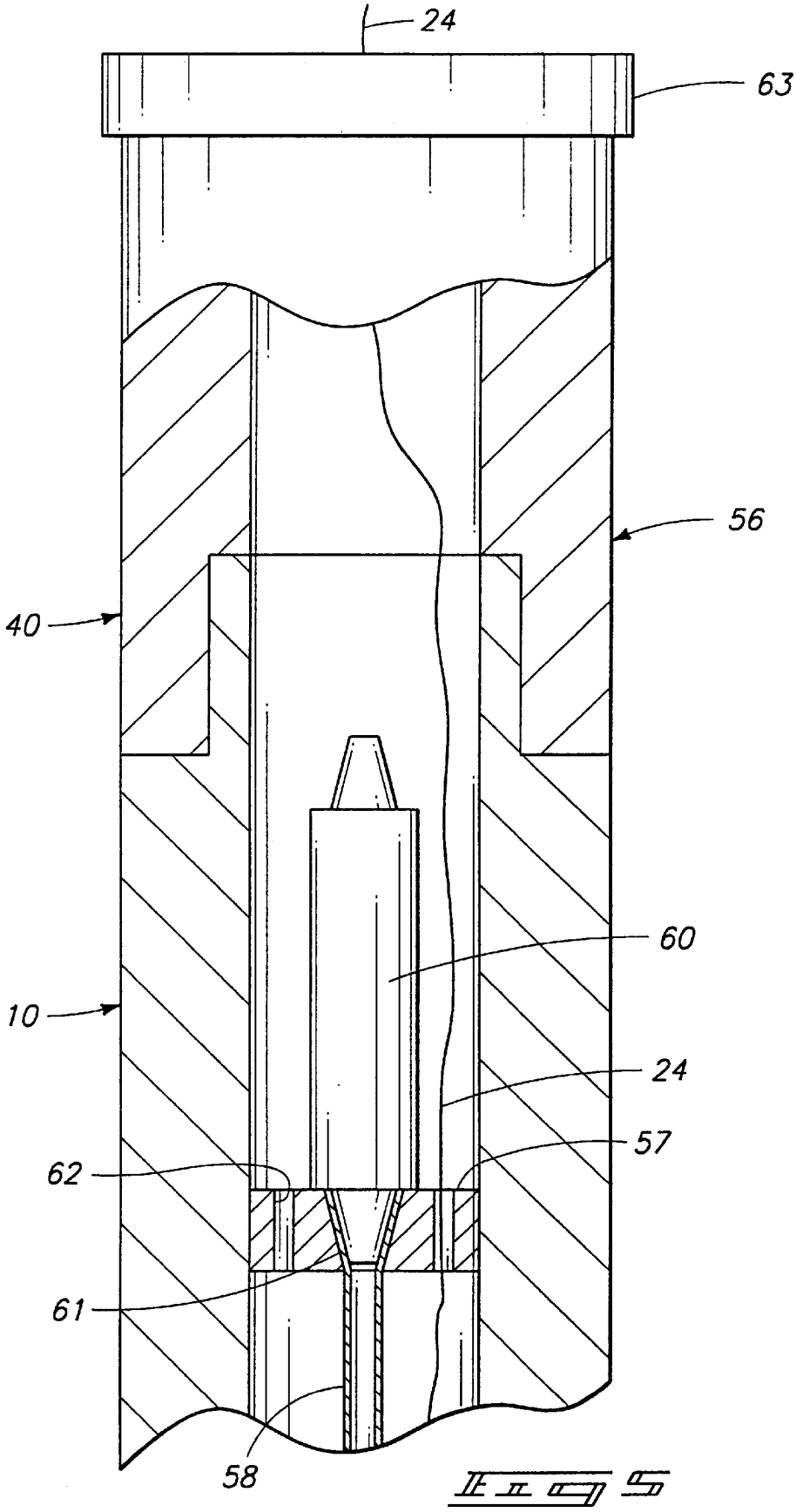
FIG. 5 is an enlarged fragmentary sectional view taken through a modified desiccant mount.

Optional Desiccant Mount (FIG. 5)

The desiccant container 31 described above would be easier to service if it were located near the top of the inner guide tube 40. One general arrangement for accomplishing this is illustrated in FIG. 5.

In this modification, the top end 56 of the inner guide tube 40 is provided with a transverse perforate support 57 extending across its inner walls. The center of support 57 includes a tube 58 leading to the previously-described reference port 27 of transducer 28. It is to be understood that the tube 58 in this instance would have a substantial length, extending downwardly almost to the lower end of tube 40.

A replaceable desiccant container 60 includes a tapered inlet that sealingly fits within a complementary flared upper end 61 of the tube 58 within support 57. Apertures 62 are formed through support 57 for venting purposes and to provide passage for the previously-described wire leads 24.

The upper end of the desiccant container 60 is vented to the interior of the inner guide tube 40, which is sealed by a removable cap 63. Provision is made within the cap 63 for sealing the extension of wire leads 24 that connect to the data logger 34 as described above. The cap 63 can be threaded or otherwise releasably fixed to the upper end of tube 40 to allow access for placement of the desiccant container 60 when replacement of its contents is required.

Figure 6:
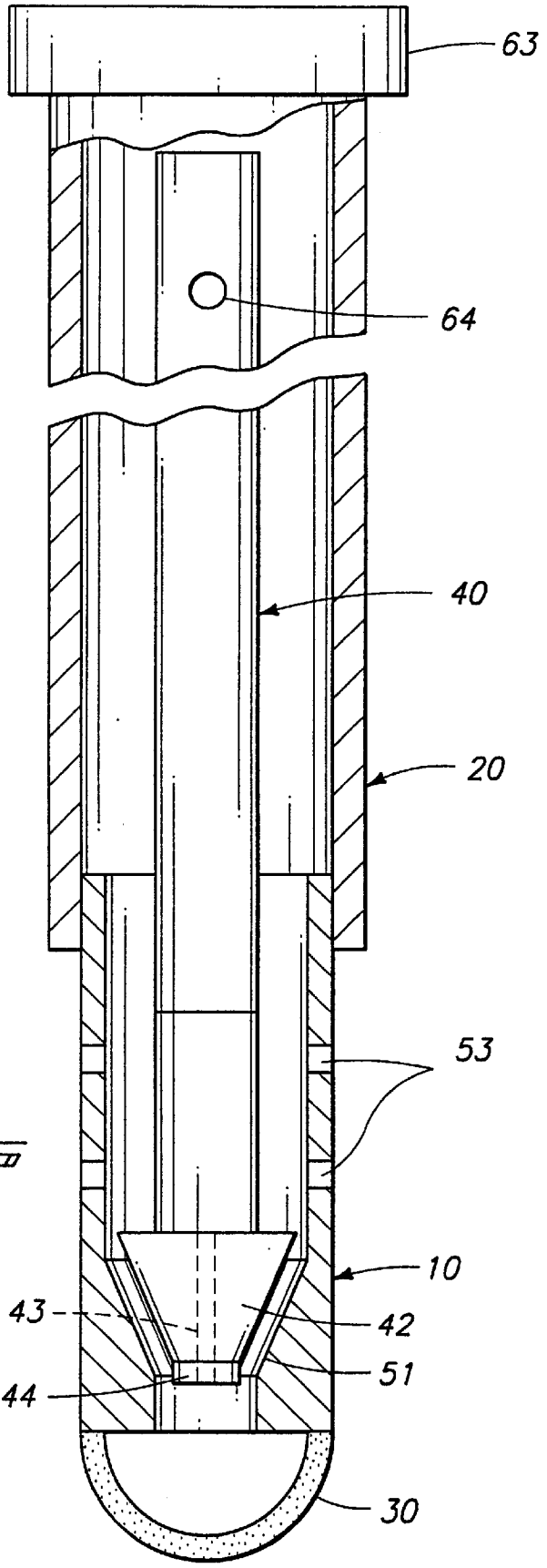
FIG. 6 is an elevational sectional view taken through a modified tensiometer.

Modified Single Seal Tensiometer (FIG. 6)

The embodiment generally illustrated in FIG. 6 is a modification of the tensiometer previously described, but using just one seal near the tensiometer measurement location. The inner guide tube 40 in this version includes only the fixed conical bottom seal or gasket 42.

The seal 42 is seated within the tapered seat 51 at the lower end of a modified perforated adaptor 10. The tapered seal 42 is apertured, as shown at 43, to provide fluid communication between the interior of attached cup 30 and the interior of tube 40, as was previously described in detail with respect to FIGS. 1–4. The mounting of the monitoring transducer and associated desiccant container within tube 40 is substantially identical to that described above.

In this embodiment, the upper end of the outer guide tube 20 is sealed by a cap 63. The upper end of the inner guide tube 40 can be open to the interior of the tube 20, or separate venting apertures 64 can be provided anywhere along its length to balance the gaseous pressures within the coaxial tubes 20 and 40. This reference pressure for the transducer is preferably directed through a desiccant (not shown) and into the inside of tube 40. The use of a desiccant will normally be required to protect the reference side of the transducer, since the inside of tubing 20 is vented to humid air at the measurement elevation determined by the position of vent holes 53. The wire leads 24 (not shown) again should be extended through the sealed cap 63 in a sealed fashion.

The operation of this embodiment is essentially the same as previously described. In essence, the seal that was provided by seal 45 in the embodiment shown in FIGS. 1–4 is replaced by the seal provided by cap 63. It is believed that the method of using this modified configuration will be clear to those skilled in this field.

Method of Operation

The present method compensates ground water data produced by use of tensiometer 10 to a true soil water potential corrected for changes in barometric pressure at the monitored elevation. It will be summarized here with reference to the first embodiment of the invention illustrated in FIGS. 1–4. It will be evident that this summary also pertains to the modifications shown in FIGS. 5 and 6.

The method first involves the step of positioning cup 30 at a selected subsoil monitoring depth by formation of bore 11 and placement of guide tube 20. As is well-known, the porous cup 30 is initially filled with water through the supporting tube 20. The supply of water can be periodically reestablished by conventional refilling subsystems within the guide tube 20, which are not illustrated as part of this disclosure.

Following insertion of inner guide tube 40 within the tube 20, fluid communication is established between the monitoring port 26 of transducer 28 and the liquid within the porous cup 30. The reference port 27 of the transducer 28 is isolated from above-grade atmospheric pressure by the sealed cap 39 (FIG. 2) or by some other form of alternative seal inserted between reference port 27 and the top end 21 of guide tube 20. Fluid communication is established between soil air at a subsoil location immediately adjacent to the porous cup 30 and the reference port 27. This is done by venting the soil air to reference port 27 through vent holes 53 and apertures 48.

More specifically, the method involves the attachment of porous cup 30 to adaptor 10 at the lower end of guide tube 20. A coaxial inner guide tube 40 houses the transducer 28 at its bottom end. It is removably positioned within guide tube 20 with the reference port 27 of transducer 28 in fluid communication with the interior of the tube 40. The exterior of the inner guide tube 40 is sealingly engaged against the interior of the guide tube 20 at elevationally spaced locations that are respectively below and above the adaptor 10 on the guide tube 20 and the corresponding perforate section 41 of the inner guide tube 40.

This process provides an engineering solution to the problem of correcting soil water potential measurements for barometric pressure changes by isolating the measuring sensor from above-grade pressure changes. By routing the soil gas pressure adjacent to the porous cup of the tensiometer to the reference port 27, the resulting data produced by use of transducer 28 is corrected to true soil water potential.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An isobaric tensiometer for measuring soil water potential at a monitoring elevation within a vadose zone, comprising:

a porous cup having a liquid-filled interior;

a differential pressure transducer having a monitoring port and a reference port;

a chamber surrounding the transducer, the chamber being in open fluid communication with the reference port of the transducer;

a closed fluid path formed through the chamber between the interior of the porous cup and the monitoring port of the transducer to permit fluid communication between interstitial soil water that contacts the porous cup at the monitoring elevation and the monitoring port; and a vent formed through the chamber to permit communication between soil air at a monitoring elevation and the reference port of the transducer;

whereby pressure data produced by the tensiometer is compensated to a true soil water potential corrected for changes in barometric pressure of the soil air at the monitoring elevation.

2. An isobaric tensiometer as set out in claim 1, further comprising:

an outer guide tube mounting the porous cup, the outer guide tube having a perforated section adjacent to its lower end;

a coaxial inner guide tube positioned within the outer guide tube, the inner guide tube having an interior that contains the transducer;

the exterior of the inner guide tube being sealingly engageable with respect to the interior of the outer guide tube at elevationally spaced locations that are respectively below and above its perforated section; and a seal formed across the interior of the inner guide tube at an elevation above the perforated section of the outer guide tube.

3. An isobaric tensiometer as set out in claim 1, further comprising:

an outer guide tube mounting the porous cup, the outer guide tube having a perforated section adjacent to its lower end;

a coaxial inner guide tube positioned within the outer guide tube, the inner guide tube having an interior that contains the transducer;

the exterior of the inner guide tube being sealingly engageable with respect to the interior of the outer guide tube at a location that is below its perforated section; and a a seal formed across the top end of the outer guide tube;

the interior of the inner guide tube being vented to the reference port of the transducer and to the interior of the outer guide tube.

4. An isobaric tensiometer as set out in claim 1, further comprising:

an outer guide tube mounting the porous cup, the outer guide tube having a perforated section adjacent to its lower end;

a coaxial inner guide tube positioned within the outer guide tube, the inner guide tube having an interior that contains the transducer;

the exterior of the inner guide tube being sealingly engageable with respect to the interior of the outer guide tube at elevationally spaced locations that are respectively below and above its perforated section; and a seal formed across the interior of the inner guide tube at an elevation above the perforated section of the outer guide tube;

an aperture formed through the first gasket as part of the closed fluid path between the interior of the porous cup and the monitoring port of the transducer.

5. An isobaric tensiometer as set out in claim 1, further comprising:

an outer guide tube mounting the porous cup, the outer guide tube having a perforated section adjacent to its lower end;

a coaxial inner guide tube positioned within the outer guide tube, the inner guide tube having an interior that contains the transducer;

the exterior of the inner guide tube being sealingly engageable with respect to the interior of the outer guide tube at elevationally spaced locations that are respectively below and above its perforated section; and a seal formed across the interior of the inner guide tube at an elevation above the perforated section of the outer guide tube; and the inner guide tube including a perforate section located adjacent to its lower end.

6. An isobaric tensiometer as set out in claim 1, further comprising:

an outer guide tube mounting the porous cup, the outer guide tube having a perforated section adjacent to its lower end;

a coaxial inner guide tube positioned within the outer guide tube, the inner guide tube having an interior that contains the transducer;

the exterior of the inner guide tube being sealingly engageable with respect to the interior of the outer guide tube at elevationally spaced locations that are respectively below and above its perforated section; and a seal formed across the interior of the inner guide tube at an elevation above the perforated section of the outer guide tub; and the first gasket being fixed at the lower end of the inner guide tube; and the second gasket being elevationally movable relative to the inner guide tube and first gasket.

7. An isobaric tensiometer as set out in claim 1, further comprising:

an outer guide tube mounting the porous cup, the outer guide tube having a perforated section adjacent to its lower end;

a coaxial inner guide tube positioned within the outer guide tube, the inner guide tube having an interior that contains the transducer;

the exterior of the inner guide tube being sealingly engageable with respect to the interior of the outer guide tube at elevationally spaced locations that are respectively below and above its perforated section; and a seal formed across the interior of the inner guide tube at an elevation above the perforated section of the outer guide tub; and the first gasket being fixed at the lower end of the inner guide tube;

the second gasket being elevationally movable relative to the inner guide tube and first gasket; and a biasing member operatively engaged between the inner guide tube and the second gasket and urging the second gasket toward the first gasket.

8. A method for compensating ground water data produced by use of an isobaric tensiometer located at a monitored elevation within a vadose zone to a true soil water potential corrected for changes in barometric pressure at the monitored elevation, comprising:

positioning a liquid-filled porous cup at selected subsoil monitoring depth;

establishing fluid communication between a monitoring port of a differential pressure transducer within the tensiometer and liquid within the porous cup;

isolating a reference port of the transducer from above-grade atmospheric pressure; and establishing fluid communication between soil air at a subsoil location immediately adjacent to the porous cup and the reference port by venting soil air to the reference port.

9. The method of claim 8, further comprising:

mounting the porous cup to the lower end of an outer guide tube;

positioning a coaxial inner guide tube containing the transducer within the outer guide tube with the reference port of the transducer in fluid communication with the interior of the inner guide tube; and sealingly engaging the exterior of the inner guide tube against the interior of the outer guide tube at elevationally spaced locations that are respectively below and above a perforate section provided at the lower end of the outer guide tube and a corresponding perforate section provided on the inner guide tube.

10. The method of claim 8, further comprising:

mounting the porous cup to the lower end of an outer guide tube;

positioning a coaxial inner guide tube containing the transducer within the outer guide tube with the reference port of the transducer in fluid communication with the interior of the inner guide tube;

sealingly engaging the exterior of the inner guide tube against the interior of the outer guide tube at an elevational location below a perforate section provided at the lower end of the outer guide tube;

sealing the top end of the outer guide tube; and venting the inner guide tube between the reference port of the transducer and the perforate section at the lower end of the outer guide tube.

11. The method of claim 8, further comprising:

mounting the porous cup to the lower end of an outer guide tube;

positioning a coaxial inner guide tube containing the transducer within the outer guide tube with the reference port of the transducer in fluid communication with the interior of the inner guide tube;

sealingly engaging the exterior of the inner guide tube against the interior of the outer guide tube at one end of a perforate section provided at the lower end of the outer guide tube by contacting the outer guide tube with a first seal mounted to the inner guide tube;

sealingly engaging the exterior of the inner guide tube against the remaining end of the perforate section by contact with a second seal member axially movable along the length of the inner guide tube; and yieldably urging the second seal member toward the first seal member by application of spring pressure.

12. A monitoring well for determining below-grade soil moisture conditions in a vadose zone, comprising:

an upright first tube having top and lower ends and having an interior which extends between its upper and lower ends, the lower end of the first tube being buried in a vadose zone of earthen soil, and the top end of the first tube being accessible from a location above-grade;

a porous cup which matingly cooperates to form a liquid-filled cavity at the lower end of the first tube and wherein the porous cup is disposed in hydraulic contact with the earthen soil in the vadose zone;

a second tube having top and lower ends and which is coaxially received within the interior of the first tube, the second tube having an interior extending between its upper and lower ends;

a first seal mounted on the lower end of the second tube and which releasably engages an extension of the first tube adjacent to its lower end, and wherein the first seal includes an aperture which permits fluid communication between the liquid-filled cavity defined by the porous cup and the interior of the second tube;

a second seal mounted adjacent to the lower end of the second tube in spaced relation relative to the first seal, the second seal releasably engaging the first tube;

the interior of the second tube being sealed off from atmospheric pressure at grade;

a pressure transducer located within the interior of the second tube and having a monitoring port and a reference port, the monitoring port of the pressure transducer being in fluid communication with the aperture formed through the first seal, and the reference port of the pressure transducer being in fluid communication with the interior of the second tube, and wherein soil water adjacent the porous cup has a capillary potential that is transmitted through the aperture in the first seal to the monitoring port of the pressure transducer;

first vents forming a perforate section through the extension of the first tube at an elevation intermediate its engagement by the first and second seals, whereby soil gas pressure adjacent to the lower end of the first tube is communicated to a chamber formed within the interior of the first tube between the first and second seals; and second vents forming a perforate section through the second conduit between the first and second seals, whereby the soil gas pressure within the chamber formed within the interior of the first tube is communicated to the interior of the second tube and to the reference port of the pressure transducer.

13. The monitoring well of claim 12 wherein the first seal is movably mounted to the second tube; and a biasing member coaxially borne on the second tube that yieldably urges one of the seals in the direction of the remaining seal.

* * * * *